United States Patent [19]

Croy

[11] 4,192,384

[45] Mar. 11, 1980

[54] SUBSEA PRODUCTION CHAMBER

[75] Inventor: David G. Croy, Houston, Tex.

[73] Assignee: Cameron Iron Works, Inc., Houston, Tex.

[21] Appl. No.: 899,000

[22] Filed: Apr. 21, 1978

[51] Int. Cl.[2] ..... E21B 7/12

[52] U.S. Cl. ..... 166/356; 175/7; 405/188

[58] Field of Search ..... 405/188; 166/362, 363, 166/364, 351, 356; 175/7, 5, 8, 9; 114/323, 324, 325, 322

[56] References Cited

U.S. PATENT DOCUMENTS

| | | | |
|---|---|---|---|
| 3,294,185 | 12/1966 | O'Neill et al. | 166/356 X |
| 3,511,312 | 5/1970 | Laffont et al. | 166/356 |
| 3,525,388 | 8/1970 | McClintock | 166/356 |
| 3,602,320 | 8/1971 | Howard | 175/8 |
| 3,855,806 | 12/1974 | Le Theresien | 166/356 X |
| 3,864,924 | 2/1975 | Piotin | 405/188 |
| 3,968,656 | 7/1976 | Ball et al. | 166/356 X |
| 3,983,937 | 10/1976 | Marquaire et al. | 166/356 |
| 4,153,113 | 5/1979 | Hopkins et al. | 166/356 |

*Primary Examiner*—James A. Leppink
*Assistant Examiner*—Richard E. Favreau
*Attorney, Agent, or Firm*—Vinson & Elkins

[57] ABSTRACT

A subsea production chamber including a vessel having a cylindrical shell with a head secured to each end of said shell, a plurality of tubular members secured vertically through said shell with each end of each of said members being open on the exterior of the shell and positioned to receive subsea guide posts, a flange secured to said shell, a spool for connecting to a production well, said flange being secured to said spool for connecting said production well into said vessel, a hatch opening into said vessel, and a connector extending through said vessel to conduct production flow to external production flow lines.

10 Claims, 5 Drawing Figures

SUBSEA PRODUCTION CHAMBER

BACKGROUND OF THE INVENTION

Production equipment for subsea well heads has been of a "wet" type in which the equipment is exposed to the water and a "dry" type in which a chamber surrounds the production equipment to maintain air at one atmosphere of pressure in the working area to allow workers to service the production equipment.

The present invention relates to an improved "dry" production chamber for a subsea well. Difficulties have been encountered with prior dry production chambers. Such prior chambers in order to be sufficiently large to accommodate the production equipment and safe working room have required guide frames having larger spacing between guide posts than the usual standard guide or the christmas tree and chamber are mounted at an abnormally high position above a standard guide frame. The larger guide frame is expensive and nonstandard and the high position can subject the wellhead to abnormally high bending moments.

SUMMARY

The present invention relates to an improved "dry" subsea well production chamber which can utilize the standard guide frame posts by receiving the posts within tubular members which are secured in vertical positions extending through the chamber and in reinforcing relationship for said chamber. The chamber includes an integral adapter flange which is readily connected to production well heads of various sizes and a suitable entry hatch for personnel.

An object of the present invention is to provide an improved dry subsea well production chamber which is installed on a standard guide frame close to the bottom.

Another object is to provide an improved dry subsea well production chamber which is quickly and easily connected to a production wellhead.

A further object is to provide an improved dry subsea well production chamber which is connected to the subsea wellhead in such a way that it may be quickly released therefrom through either of two connections.

Still another object is to provide an improved subsea well production chamber having flow loops connecting to the christmas tree in the chamber which loops are of sufficient radius to accommodate through flowline or pumpdown equipment and tools.

BRIEF DESCRIPTION OF THE DRAWINGS

These and other objects and advantages are hereinafter set forth and explained with reference to the drawings wherein.

DESCRIPTION OF THE PREFERRED EMBODIMENT

Figure 1:
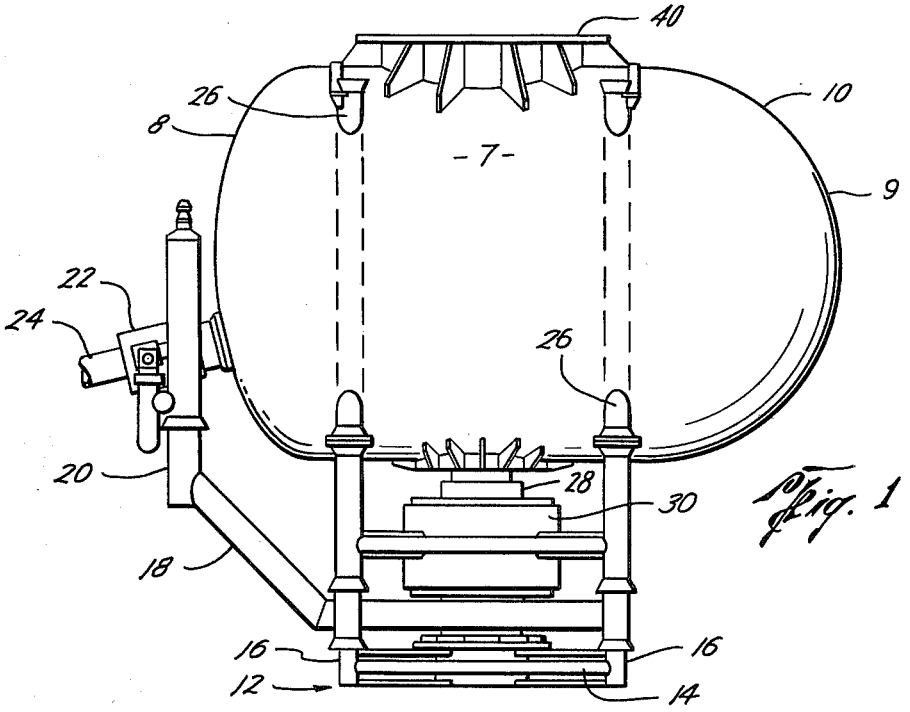
FIG. 1 is a side elevation view of the improved subsea production chamber of the present invention shown on a subsea wellhead.

The improved subsea production chamber 10 formed of shell 7, eliptical head 8 and hemispherical head 9 is shown in FIG. 1 installed on a subsea wellhead 12. Even though not shown, a spherical shell may be used. The subsea wellhead 12 has the wellhead guide frame 14 with the standard guide posts 16 supported thereon and the usual guide lines (not shown) extending upwardly to the water surface. The pipeline connector guide frame 18 is shown in position on wellhead guide frame 14 with its guide posts 20 extending upwardly. The pipeline connector 22 is shown supported on the guide posts 20, connecting between the pipeline 24 and the chamber 10. The details of the preferred form of pipeline connector are shown in the David G. Croy et al patent application Ser. No. 898,968, filed Apr. 21, 1978 entitled "Subsea Flowline Connector".

The chamber 10 includes the pipes 26 extending vertically through the chamber 10 as shown and positioned to receive the guide posts 16. The pipes 26 thus are sufficiently large in diameter to fit over the guide posts 16 and also are welded at both ends to the shell 7 of chamber 10 so that chamber 10 is water tight. This structure has the advantage of strengthening the shell 7 of chamber 10 and of allowing chamber 10 to be seated on the wellhead 12 without having to use a special wellhead guide frame with wide spaced posts or having to support the chamber above the wellhead guide posts.

The connection to the wellhead 12 is provided by the adapter spool 28 which is connected to the remotely controlled christmas tree connector 30 and is secured to the flange 32 by studs 34 and nuts 36. The flange 32 is made an integral part of the chamber 10 as by welding or other suitable means.

The chamber 10 is made up on the surface with the adapter spool 28 secured to the flange 32 and with the remotely controlled connector 30 secured to the adapter spool 28. Thus, the chamber 10 may be lowered into position on the guide frame 14 and remotely connected to the wellhead 12 by the actuation of connector 30.

Access to the interior of chamber 10 is available through the entry hatch 38. Hatch 38 is operable from both the interior and exterior of chamber 10. The docking plate 40 is positioned above and in surrounding relation to the entry hatch 38 to allow a submersible craft or bell to land and seal thereon so that personnel may be delivered and retrieved from the chamber 10.

Entry hatch 38 is composed of two removable concentric hatch members. Inner hatch closure member **38*a* is used to transfer personnel and small parts into the chamber. The larger outer hatch closure member 38*b* is removed to transfer the christmas tree 42**.

Figure 2:
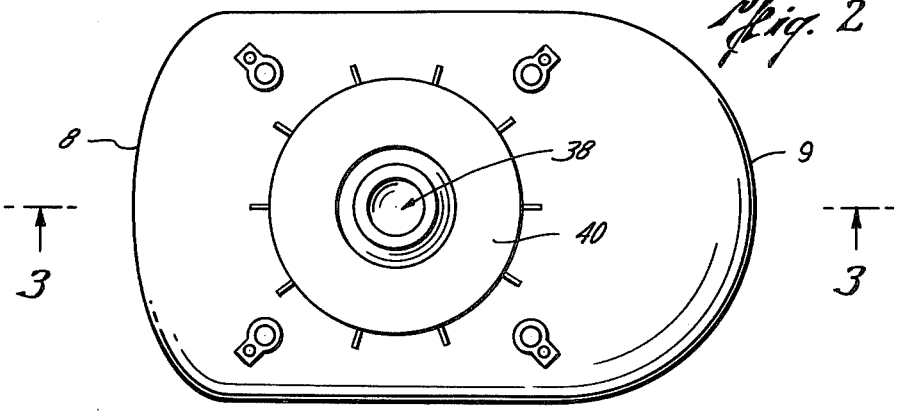
FIG. 2 is a plan view of the production chamber shown in FIG. 1.
Figure 3:
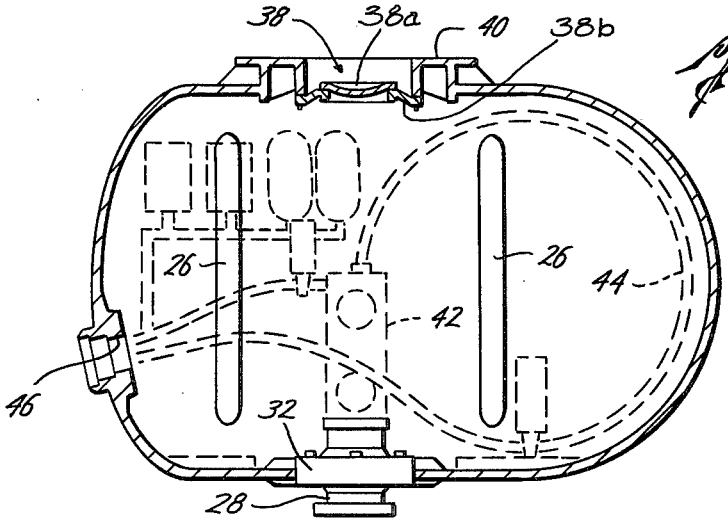
FIG. 3 is a sectional view taken along line 3—3 in FIG. 2.
Figure 4:
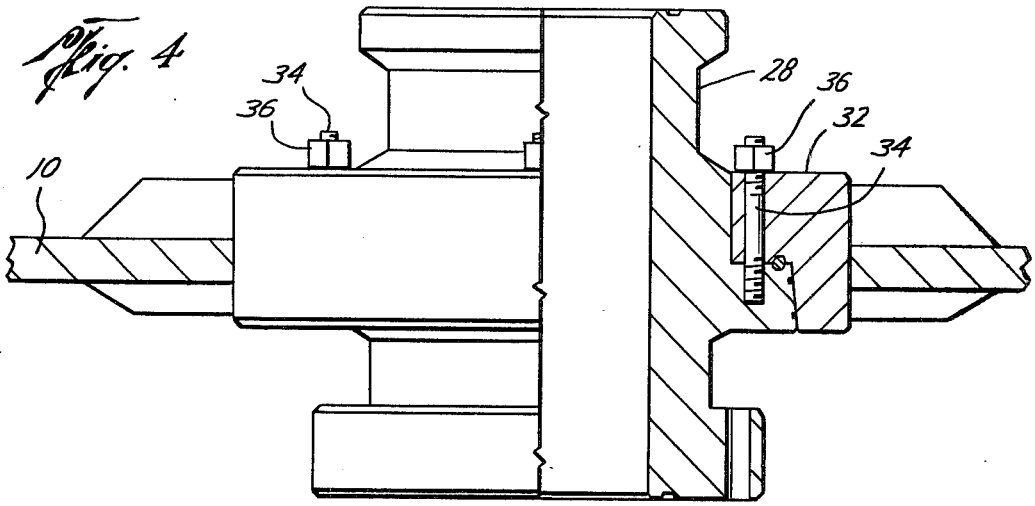
FIG. 4 is a detail sectional view of the flange and adapter spool connection into the chamber.

The balance of the christmas tree including blowout preventers 42 are secured to the upper end of adapter spool 28 within chamber 10. The flowline loops 44 extend from the upper end of the blowout preventers 42 to the flowline port 46 into which the pipeline connection 22 connects. As shown in FIGS. 1, 2 and 3 the end of chamber 10 in which loops 44 are positioned is the end with the hemispherical head 9. The hemispherical shaped head 9 provides sufficient space for the desired radius of flowline loops 44 without increasing the diameter of chamber 10. Such radius should be sufficient to receive through flowline tools, controls and equipment.

Figure 5:
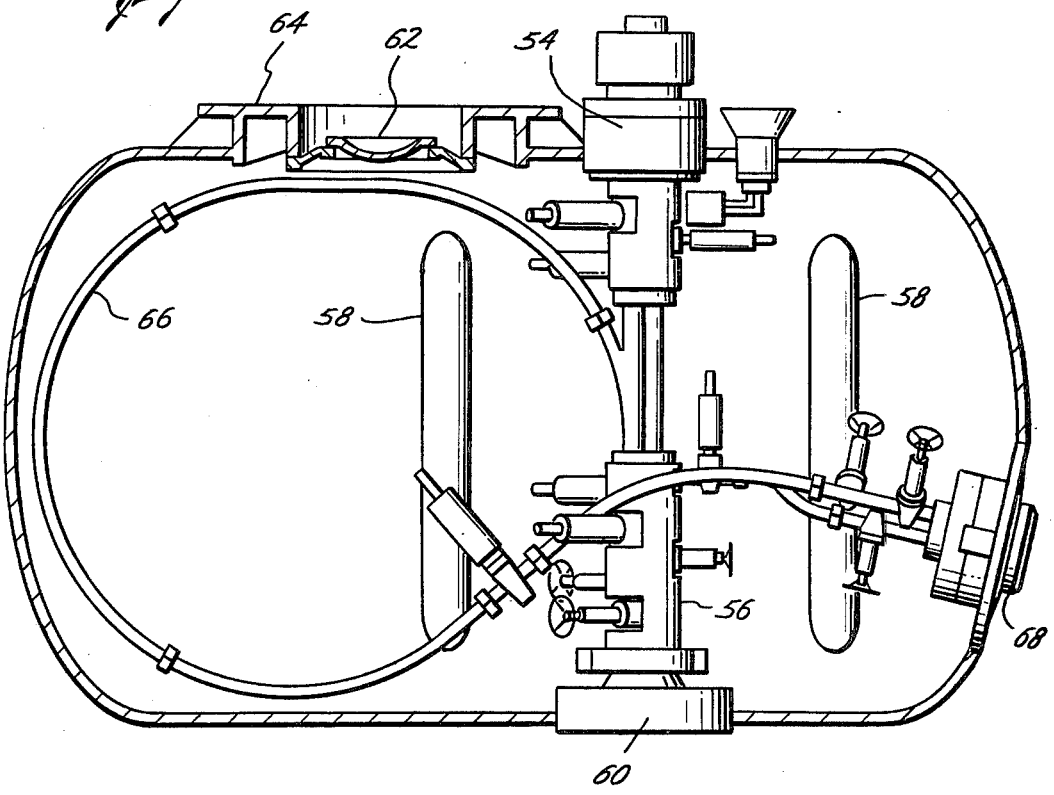
FIG. 5 is a sectional view of a modified form of chamber of the present invention.

In those locations where vertical access to the christmas tree is desired without moving the subsea chamber, the modified form of chamber shown in FIG. 5 is used. This chamber 52 is similar to chamber 10 except that its shell is longer to provide the opening 54 through its shell directly above the christmas tree 56 and including the means for closing opening 54 so that it may be used for access to christmas tree 56 without allowing sea water to flow into the chamber. Chamber 52 has the pipes 58 extending vertically therethrough and welded to the shell of chamber 52. Pipes 58 are positioned to receive the guide posts of a standard guide frame. The flange 60 connects the internal christmas tree 56 to the wellhead (not shown) and is secured to the shell of chamber 52 as an integral part thereof. Entry hatch 62 is provided for entry and exit from chamber 52 and is surrounded by docking plate 64.

The flow loops 66 extend from tree 56 to the flowline port 68 for connection to a subsea pipeline (not shown). The radii of flow loops 66 and 44 are large to allow downhole tools, controls and equipment to be pumped therethrough.

With the improved chamber of the present invention, it can be used in position on a standard guide frame without having to have a small size chamber or have it supported a distance above the ocean floor. Thus, the chamber may be sufficiently large to accommodate the flowline loops used for pumpdown equipment. Also, the use of the vertical tubes extending through the chamber to receive the guide posts provides a reinforcing for the chamber wall.

What is claimed is:

1. A subsea production chamber for location on the guide posts of a conventional subsea wellhead guide frame comprising a vessel capable of withstanding external hydrostatic pressure, a plurality of tubular reinforcing members secured vertically through said vessel, said tubular members being arranged to be received over the posts of a conventional guide frame, means for connecting said vessel to a producing well, means for connecting said well to production flowlines, and a hatch connected through said vessel to provide access to the interior of said vessel.

2. A subsea production chamber according to claim 1 wherein said vessel is sufficiently large to accommodate a through the flowline loop therein.

3. A subsea production chamber according to claim 1 wherein said vessel includes a cylindrical shell and a pair of heads each connected to one end of said shell.

4. A subsea production chamber according to claim 3 including a docking plate mounted on the exterior of said vessel in surrounding relationship to said hatch.

5. A subsea chamber according to claim 2 wherein said hatch includes at least two separable concentric closure members.

6. A subsea production chamber according to claim 1 wherein said means for connecting the vessel to a producing well includes a flange secured in the lower portion of said vessel around an opening through the vessel, an adapter spool for connection to said well and extending into said opening, said adapter spool having an external flange intermediate its ends and adapted to engage said flange secured to said vessel, and means for securing said vessel flange to said adapter spool flange.

7. A subsea production chamber according to claim 6 including a christmas tree within said vessel and connected to said adaptor spool.

8. A subsea production chamber according to claim 7 including an opening formed in said shell directly above said christmas tree for servicing said well through said chamber, and means for closing said opening.

9. A subsea production chamber according to claim 7 wherein said production connecting means includes at least one flowline loop within said vessel connecting from said christmas tree to the production flowlines.

10. A subsea production chamber according to claim 9 wherein one of said heads is hemispherical and said loop is positioned partly within said hemispherical head.

* * * * *